United States Patent [19]

Chang

[11] 4,004,987

[45] Jan. 25, 1977

[54] METHOD FOR THE PREPARATION OF RARE AND PRECIOUS METALS BY ELECTROLYTICAL AMALGAMATION USING ION EXCHANGE MEMBRANE

[75] Inventor: Chau-Ting Chang, Taiwan, China /Taiwan

[73] Assignee: Institute of Nuclear Energy Research, Taiwan, China /Taiwan

[22] Filed: Oct. 15, 1974

[21] Appl. No.: 514,479

[52] U.S. Cl. ..... 204/1.5; 204/124; 204/257

[51] Int. Cl.[2] ..... C25C 5/02

[58] Field of Search ..... 204/1.5, 124

[56] References Cited

UNITED STATES PATENTS

| | | | |
|---|---|---|---|
| 2,773,820 | 12/1956 | Boyer et al. | 204/124 X |
| 2,781,303 | 2/1957 | Boyer et al. | 204/124 X |
| 2,805,985 | 9/1957 | Wolter | 204/124 X |
| 3,086,926 | 4/1963 | Helton et al. | 204/124 X |
| 3,252,879 | 5/1966 | Sommer et al. | 204/93 |

OTHER PUBLICATIONS

Hopkins, The Electrochemical Society, Preprint 89--8, Apr. 15, 1946.

Perry et al., Chemical Engineers Handbook, McGraw–Hill, Chemical Engineering Series, 1973, pp. 17–52 to 17–58.

*Primary Examiner*—Leland A. Sebastian

[57] ABSTRACT

Metal amalgams are prepared electrolytically by using an ion exchange membrane for the purpose of adjusting pH during the course of electrolysis. The subsequent thermal decomposition of the thereby obtained amalgam under reduced pressure brings forth metallic powder and solid metal.

3 Claims, 1 Drawing Figure

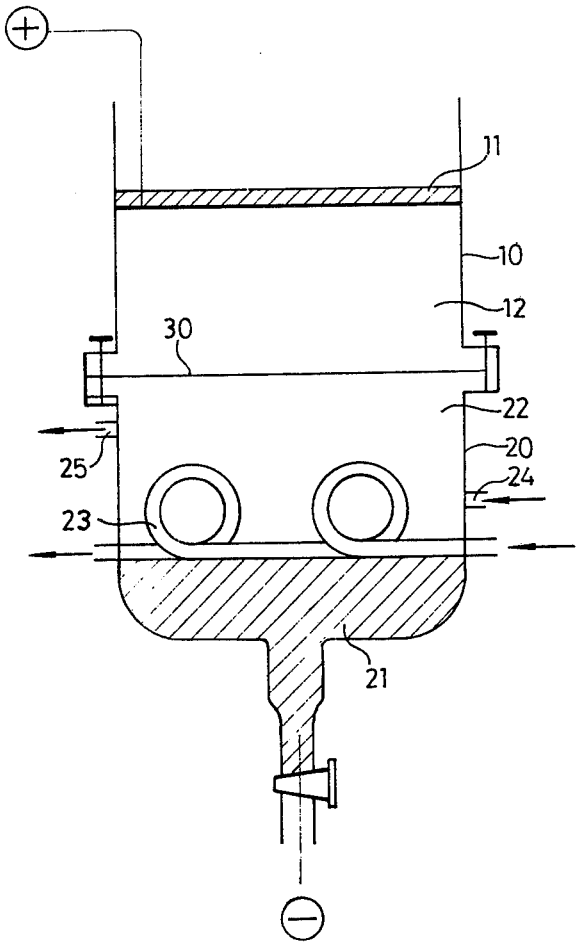
11
10
12
30
22
20
24
25
23
21

METHOD FOR THE PREPARATION OF RARE AND PRECIOUS METALS BY ELECTROLYTICAL AMALGAMATION USING ION EXCHANGE MEMBRANE

FIELD OF INVENTION

The present invention relates to a method for the preparation of metal directly from aqueous solutions, and apparatus thereof, and more particularly, to the electrolytical amalgamation of metals from their respective aqueous solutions and the recovery of them by subsequent thermal decomposition of the amalgams under reduced pressure and/or in an inert gas atmosphere at relatively low temperature.

The present invention may find wide application in the preparation of various metals directly from their aqueous solutions, especially for those rare and precious metals such as uranium and transuranium elements. The method is far simpler than the conventionally adopted metallurgical process.

BACKGROUND OF INVENTION

The electrolytical amalgamation of metals directly from aqueous solutions of the respective metal ions is not always feasible, because of hydrolysis and/or precipitation caused by the change of acidity in the course of electrolysis. Therefore, its applicability for metals other than alkali metals, iron and nickel etc. is quite limited.

The electrolytical reduction of metallic ions in aqueous solutions into metallic state taking use of a mercury pool as cathode and an inert metal such as platinum as anode has been well known. The amalgams of alkali metals and transition metals (such as iron, cobalt and nickel etc.) can thus be easily made. However, for many other metals hydrolysis and/or precipitation during the process of electrolysis severely restrict its wider applicability.

Taking uranium as an example, the reduction of uranium ion into metallic state is known to proceed according to $$UO_2^{2+} + 4H^+ + 6e^- \rightleftarrows U + 2H_2O$$

Direct electrolysis using a mercury pool as cathode will unavoidably lead to the elevation of pH or the lowering of acidity and consequently to the precipitation of $UO_2$ and hydroxides. The chemical reaction is thus prevented from proceeding beyond tetravalent state, U(1V). The conventionally adopted process of extracting uranium ion in aqueous solution by sodium amalgam is rather tedious and gives rather low yield. The uranium ion is exchanged with sodium atoms in the amalgam and thus reduced into metallic state. The highest attainable yield published of late employing this process by Malan et al. gives 50 mgU/mlHg. (J. Inorg. Nucl. Chem. 33 3097 (1974). Here, the elevation of pH is also the main problem to be overcome, since it has been found that the optimum pH range for the uranium amalgamation is narrowly restricted to 3–4. Even though the pH of the electrolytic solution is preadjusted, it will change in the course of electrolysis. In order to keep virtually constant acidity, a specially designed electrolytical cell was constructed and used, which is comprised of two main compartments divided by an ion exchange membrane: anode compartment and cathode compartment. The amalgamation takes place in the mercury-cathode compartment where hydrogen ions are consumed, however, these will be continuously supplied through the ion exchange membrane from the anode compartment. The pH of the electrolytic solution will thus be kept constant.

The thereby obtained amalgam is then thermally decomposed under reduced pressure and/or in an inert gas atmosphere and heated up to the melting point temperature the metal can thus be obtained. The overall process for the production of metal will be greatly simplified as compared with the conventional metallurgy, it has more economical advantages especially for the preparation of rare and precious metals, such as uranium, neptunium and transuranium.

SUMMARY OF INVENTION

Therefore, the main object of the present invention is to provide a method and apparatus for the preparation of metal amalgams using an ion exchange membrane for the purpose of adjusting acidity during the course of electrolysis. The subsequent thermal decomposition of the thereby obtained amalgam under reduced pressure bring forth metallic powder and solid metal. The overall process of the present invention greatly simplifies the conventional metallurgy and is economically advantageous, especially for the production of rare and precious metals such as uranium, neptunium and transuraniums.

Other objects and features of the present invention will become apparent from the following detailed description to be taken in conjunction with the annexed drawing.

BRIEF DESCRIPTIONS OF DRAWING

FIG. 1 depicts a preferred embodiment of the Electrolytical cell for Amalgamation using ion exchange membrane applied for the present invention.

DETAILED DESCRIPTIONS OF THE PREFERRED EMBODIMENTS

An electrolytical cell for amalgamation is shown in FIG. 1. The geometrical shape of the cell may have any other alterations. Essentially the cell is composed of two compartments, the anode compartment 10 and the cathode compartment 20 divided by an ion exchange membrane 30: the anode compartment 10 consists of a Hastelloy C alloy or any other inert metal 11 and an acidic solution 12, while the cathode compartment 20 with a mercury pool 21 as cathode and filled with metallic ion solution 22. A cooling condenser 23 is placed in the cathode compartment in order to keep constant temperature. A solution inlet 24 and outlet 25 is provided and the electrolytic solution is circulated between a reservoir (not shown) and the cathode compartment in order to keep virtually constant metallic ion concentration.

The electrolysis using the electrolytical cell as shown in FIG. 1 is simple and will be illustrated in the following examples. The process is carried out at ambient temperature and pressure. In order to keep constant temperature and virtually constant concentration of electrolytic solution in the cathode compartment the solution has been circulated between a reservoir and the cathode compartment. The invention is illustrated by the following examples, to which it is not limited.

EXAMPLE 1

Fifteen milliliters of mercury and 400 ml 0.1 M uranium acetate solution were used. The anode compartment was filled with a ca. 3:1 mixture of sulfuric acid and sodium sulfate making up total sulfate ion concentration 1 M. Electrolysis was carried out at 10 V and 3 Amp for 2 hours. It was found that one third of the mercury formed a solid mass which contained as high as 1.1 g U/ml Hg, while the liquid portion contained 7.4 mg U/ml Hg. About 70% of the uranium ion were amalgamated. A portion of the amalgam was digested with 0.5 N HCl. The aqueous solution became red and then green, characteristics of trivalent and tetravalent states of uranium, indicating that uranium in the amalgam is in metallic state.

Part of the amalgam obtained from above was heated under reduced pressure around $10^{-2}$ mm Hg at 400° C, one gram of fine metal powder was obtained, which converted readily into $UO_2$ after exposing to the air. Another portion of the amalgam was heated up to 1300° C, 5 grams solid metal of density 19.2 gm/cm$^3$ was obtained. The identification was made by X-ray diffraction.

EXAMPLE 2

One gram of uranium nitrate was neutron-irradiated and Np-239 was separated from the target by conventional TBP extraction.

The same process described in EXAMPLE 1 was applied for neptunium-239, however, at much lower current of 0.2 Amp. After a one-hour electrolysis 50% of the radioactivity was found in mercury.

The above embodiment is given only for illustration purpose and not by way of limitation, and modification will become evident to those skilled in the art which will fall within the scope of attached claims.

I claim:

1. Method for the preparation of rare and precious metals by electrolytical amalgamation comprising steps of amalgamation and thermal decomposition and characterized by amalgamating a metal from the group consisting of uranium, neptunium and transuranium from the relevant aqueous solution electrolytically in a cell having two compartments with an ion exchange membrane in between for the purpose of adjusting the pH during the course of electrolysis, and then thermally decomposing the amalgam obtained under reduced pressure to produce metallic powder and solid metal.

2. Method according to claim 1, wherein the metal to be prepared is uranium, characterized by filling one compartment which comprises an anode compartment with a ca. 3:1 mixture of sulfuric acid and sodium sulfate making up total sulfate ion concentration 1 M, and filling the other compartment which comprises a cathode compartment with 0.1 M uranium ion solution.

3. Method according to claim 1, wherein the counterion of uranium ion is acetate.

* * * * *